US012196045B2

(12) United States Patent
Galle et al.

(10) Patent No.: US 12,196,045 B2
(45) Date of Patent: Jan. 14, 2025

(54) CONNECTION ASSEMBLY

(71) Applicant: Seahorse Technologies, Inc., Houston, TX (US)

(72) Inventors: Gary Galle, Houston, TX (US); Justin Whitehead, Houston, TX (US)

( * ) Notice: Subject to any disclaimer, the term of this patent is extended or adjusted under 35 U.S.C. 154(b) by 306 days.

(21) Appl. No.: 17/677,755

(22) Filed: Feb. 22, 2022

(65) Prior Publication Data

US 2023/0265723 A1 Aug. 24, 2023

(51) Int. Cl.
*E21B 17/043* (2006.01)
*E21B 17/08* (2006.01)

(52) U.S. Cl.
CPC ..... *E21B 17/043* (2013.01); *E21B 17/085* (2013.01)

(58) Field of Classification Search
CPC ..... E21B 17/085; E21B 17/046; E21B 17/043
See application file for complete search history.

(56) References Cited

U.S. PATENT DOCUMENTS 3,986,729 A * 10/1976 Taylor ..... F16L 37/002 285/18
4,433,859 A * 2/1984 Driver ..... F16L 37/002 285/317
4,661,016 A * 4/1987 Baugh ..... E21B 33/038 166/345
4,902,044 A * 2/1990 Williams ..... F16L 37/002 166/344
6,129,149 A * 10/2000 Beall ..... E21B 33/038 166/344
9,334,705 B1 * 5/2016 Ward ..... E21B 19/002
2007/0152441 A1 * 7/2007 Jennings ..... F16L 37/002 285/90
2020/0011147 A1 * 1/2020 Zhu ..... E21B 33/038

FOREIGN PATENT DOCUMENTS

EP 0158455 A2 * 10/1985
EP 0579878 A1 * 1/1994
FR 2557194 A1 * 6/1985
GB 2431185 A * 4/2007 ..... E21B 33/035

* cited by examiner

*Primary Examiner* — Zachary T Dragicevich
*Assistant Examiner* — James A Linford
(74) *Attorney, Agent, or Firm* — Werner IP Law, P.C.

(57) ABSTRACT

A connection assembly for connecting first and second tubular members. The first tubular member has an external latching formation and there is a latch which is radially movable and configured to selectively engage the latching formation. A cam or drive ring is in surrounding relationship to the latch. There is a collar threadedly received on the second tubular body. Rotation of the collar to effect downward movement forces the drive ring downwardly and into engagement with the dog such that the dog is moved radially inwardly to engage the latching formation.

20 Claims, 4 Drawing Sheets

CONNECTION ASSEMBLY

FIELD OF THE INVENTION

The present invention relates to connection assembly and, more specifically, to a rapid make-up connection assembly for connecting a first body having a bore to a second body having a bore.

BACKGROUND OF THE INVENTION

In many industries it is necessary to connect a first fluid-carrying body or line to a second fluid-carrying body or line. In particular, in the oil and gas industry connection assemblies are commonly used to connect wellheads, tubular members such as risers as well as other tubular components involved in the production, gathering, and transportation of produced fluids.

Connection assemblies that are commonly used include threaded connections, with or without flanges, clamping mechanisms which compress the tubular members using single or multiple drive screws or bolts, and locking mechanisms using dogs, split rings, collets and the like. The connections employing locking mechanisms typically use activation or driving rings which are axially moved using discrete or annular hydraulic systems.

SUMMARY OF THE INVENTION

In one aspect, the present invention relates to a connection assembly for tubular members which does not require a hydraulic system to preload the connection.

In another aspect, the present invention relates to connection assemblies for connecting first and second bodies, preferably bodies having bores therethrough, which can be rapidly made-up and which are capable of producing significant and repeatable preload.

In still another aspect, the present invention relates to connection assemblies which can be made up using low torque, e.g., hand tighten and still eliminate all gaps due to tolerances.

In yet a further aspect, the present invention relates to a connection assembly for connecting first and second tubular members which utilizes a primary make-up assembly and a secondary make-up assembly to achieve a connection possessing significant preload.

These and further features and advantages of the present invention will become apparent from the following detailed description, wherein reference is made to the figures in the accompanying drawings.

DETAILED DESCRIPTION OF PREFERRED EMBODIMENTS

Figure 1:
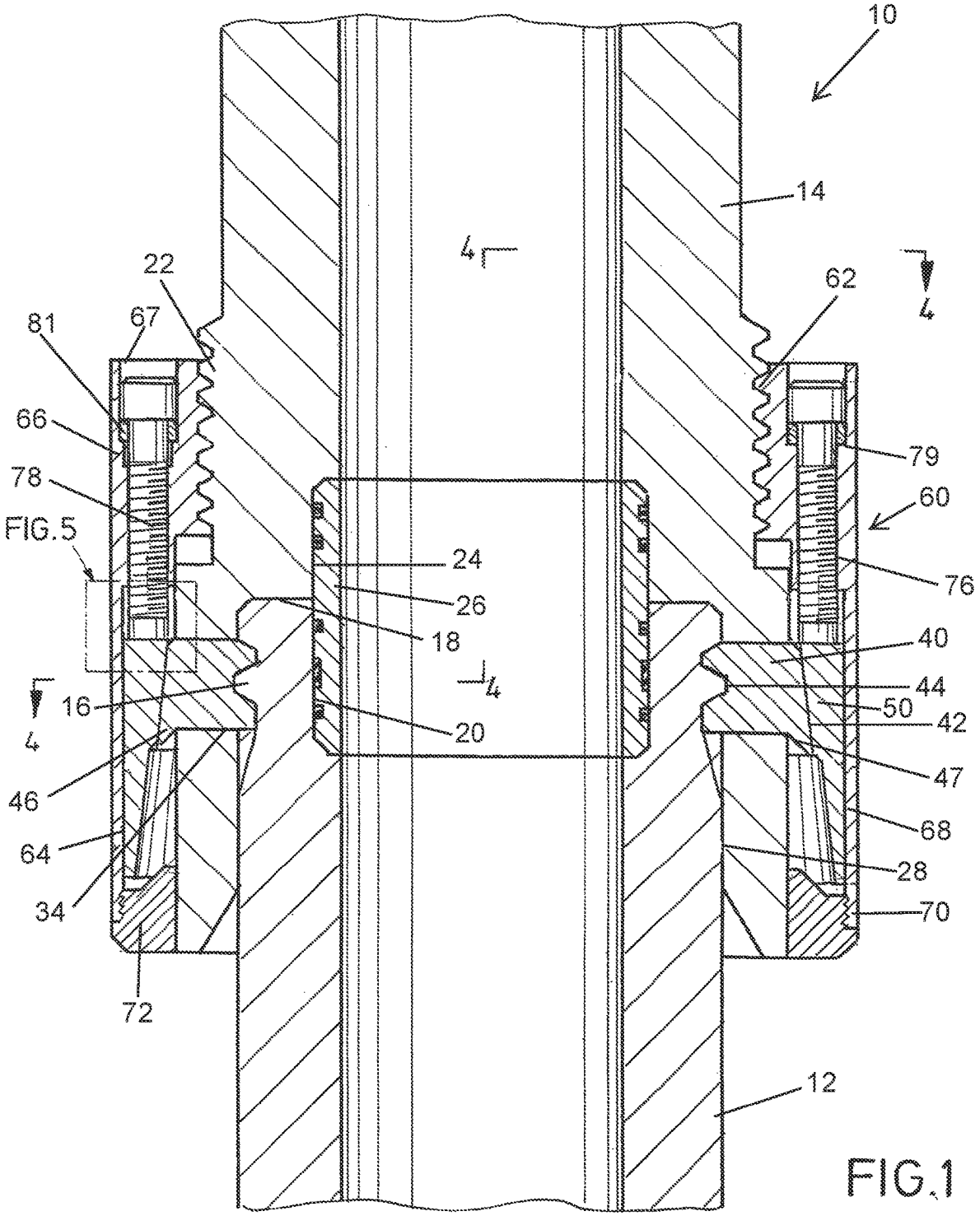
FIG. 1 is an elevational view, partly in section, showing one embodiment of the connection assembly of the present invention in a fully made-up position.

Embodiments of the invention are described more fully hereafter with reference to the accompanying drawings.

Elements that are identified using the same or similar reference characters refer to the same or similar elements. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus/assembly in use or operation in addition to the orientation depicted in the figures. For example, if the apparatus/assembly in the figures is turned over, elements described as being "below" or "beneath" other elements or features would then be oriented "above" the other elements or features. Thus, the exemplary term "below" can encompass both an orientation of above and below. The apparatus/assembly may be otherwise oriented (rotated 90 degrees or at other orientations) and the spatially relative descriptors used herein may likewise be interpreted accordingly.

FIG. 1 shows one embodiment of the connection assembly 10 of the present invention in a fully made-up position. The connection assembly 10 comprises a first tubular member 12 and a second tubular member 14. Tubular member 12 has an annular radially outwardly projecting rib 16 formed proximal an end surface 18 of first tubular member 12. First tubular member 12 also has a counterbore 20 extending from end surface 18.

Second tubular member 14 has an external thread 22 and a counterbore 24, counterbores 24 and 20 being concentric as can be seen in FIG. 1. Counterbores 20 and 24 cooperate to form an annular radially inwardly opening recess in which is received an annular seal assembly 26 of a well-known type. Second tubular member 14 also has a second counterbore, proximal the lower end of second tubular member 14, the upper end of first tubular member 12 being received in the counterbore 28. In effect, first and second tubular bodies 12 and 14 form a bell-spigot joint.

Figure 3:
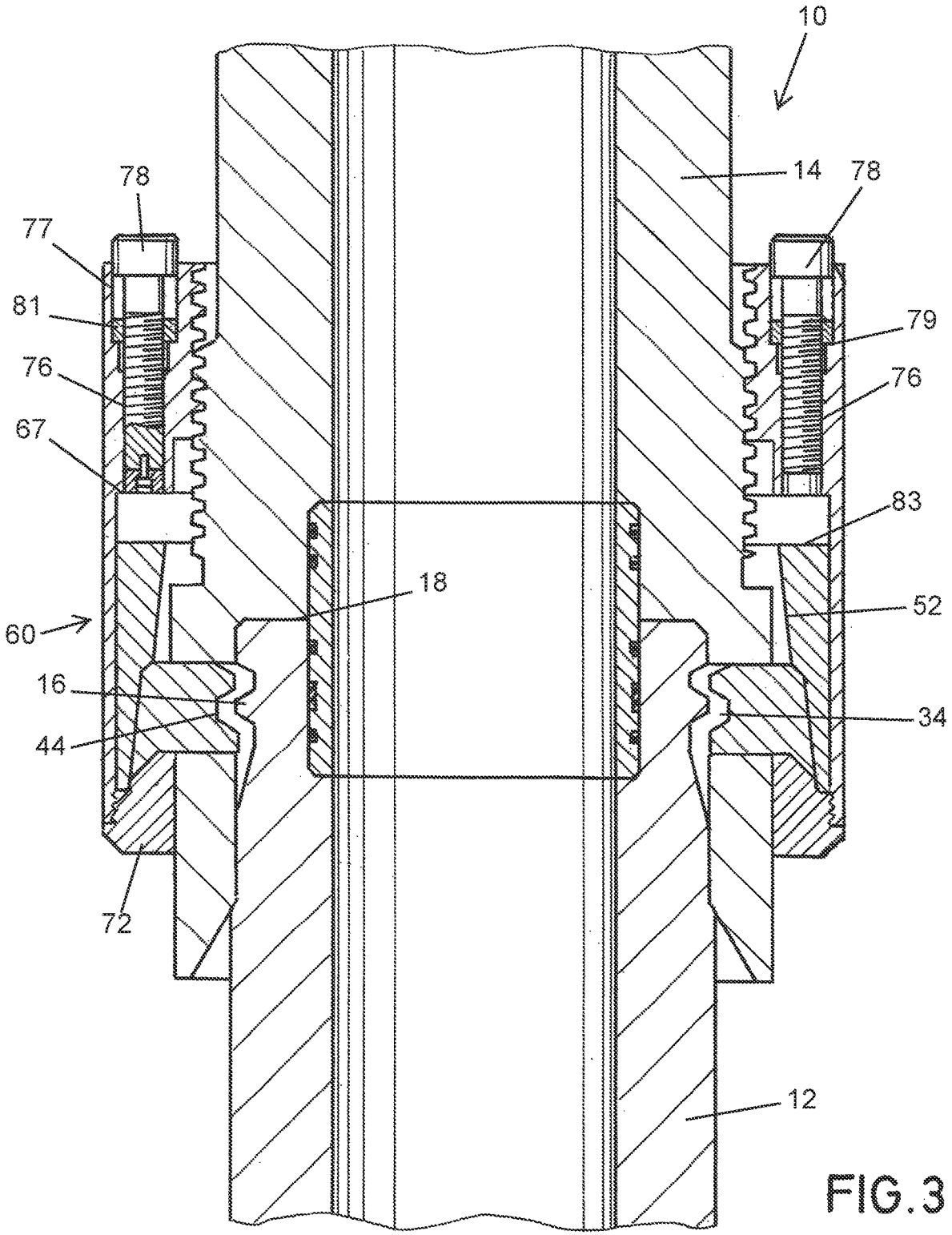
FIG. 3 is a view similar to FIG. 1 showing one embodiment of the connection assembly in a landed, but not locked position.
Figure 4:
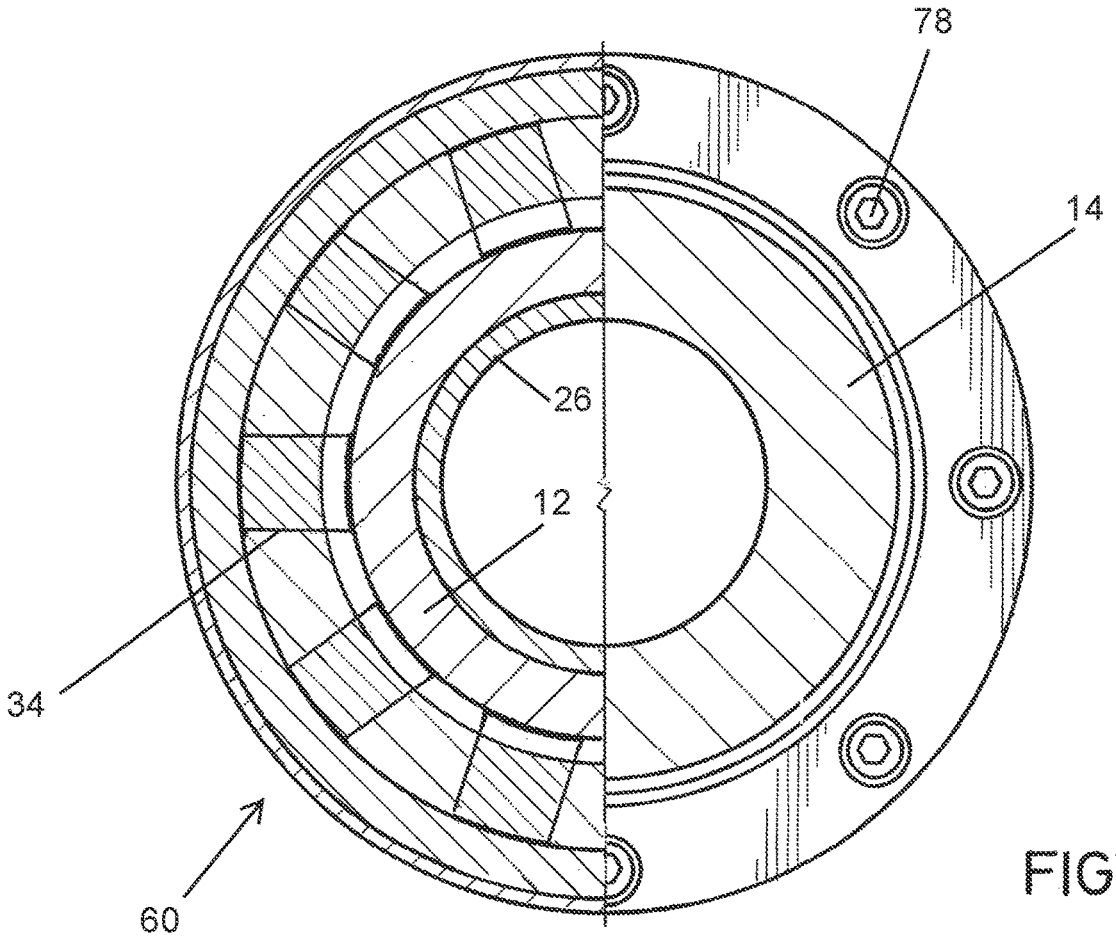
FIG. 4 is a cross-sectional view taken along the lines 4-4 of FIG. 1.

As best seen with reference to FIGS. 3 and 4, second tubular member 14 has a plurality of circumferentially spaced windows 34 effectively forming a cage for a series of circumferentially spaced dogs 40 positioned in windows 34. Each of dogs 40 has a radially outwardly facing tapered surface 42 and a radially inwardly facing annular groove 44. Additionally each of dogs 40 has an axially extending projection 46 which has a tapered surface 47 for a purpose described hereafter.

In surrounding relationship to dogs 40 is an activation or cam ring 50. Activation ring 50 has an annular radially inwardly facing, axially extending tapered surface 52, tapered surface 52 matingly engaging tapered surface 42 on dog 40. Further the top surface of ring 50 forms an annular axially facing shelf 83. As seen in FIG. 1 when the connection assembly 10 is fully made up, annular rib 16 is received in groove 44 in dog 40.

There is a collar shown generally as 60 which has an internal threaded portion 62 which threadedly engages threaded portion 22 on second tubular member 14. Collar 60 also has a counterbore 64 resulting in collar 60 having an upper wall section 66 of a first internal diameter and a lower wall section 68 of a second, larger internal diameter thereby forming an annular, axially facing shoulder 67. Formed on the lower end of collar 60 is a second internally threaded portion 70, threaded portion 70 engaging a retraction ring 72. It will be appreciated that rotation of collar 60 results in rotation of retraction ring 72.

Figure 5:
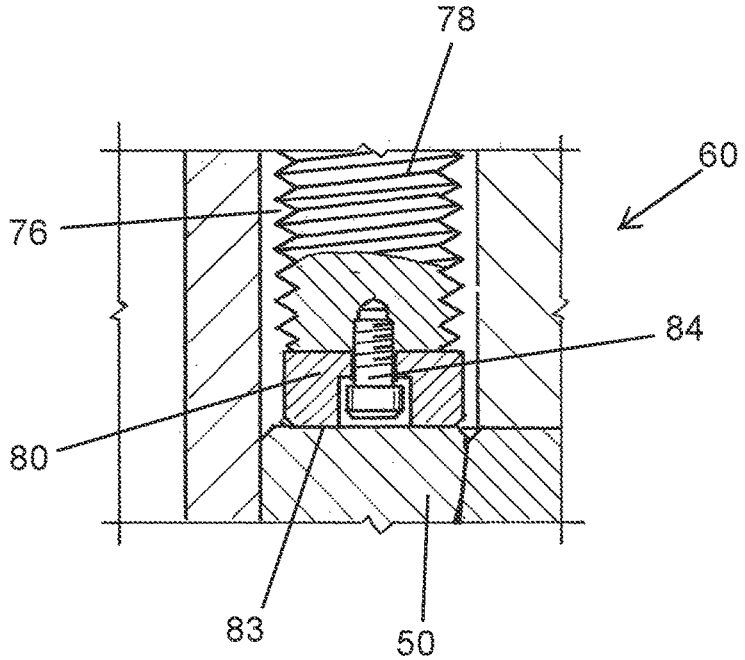
FIG. 5 is an enlarged view of a portion of FIG. 1.

There are a plurality of circumferentially spaced axially extending internally threaded bores 76 formed in wall section 66 of collar 60. Each bore has a counterbore 77 forming an axially facing shoulder 79. There is a bolt bushing 81 received in counterbore 77. Received in each threaded bore 76 is a threaded rod 78, e.g., cap bolt, a bushing 81 being received between the head of bolt 78 and shoulder 79. As seen with reference to FIGS. 1 and 5, bolts 78 are connected at their lower ends to spacers 80 by screws 84 received through spacers 80 and into threaded bores in the lower ends of bolts 78. Spacers 80 engage the annular axially facing shelf 83 formed on activation ring 50.

Figure 2:
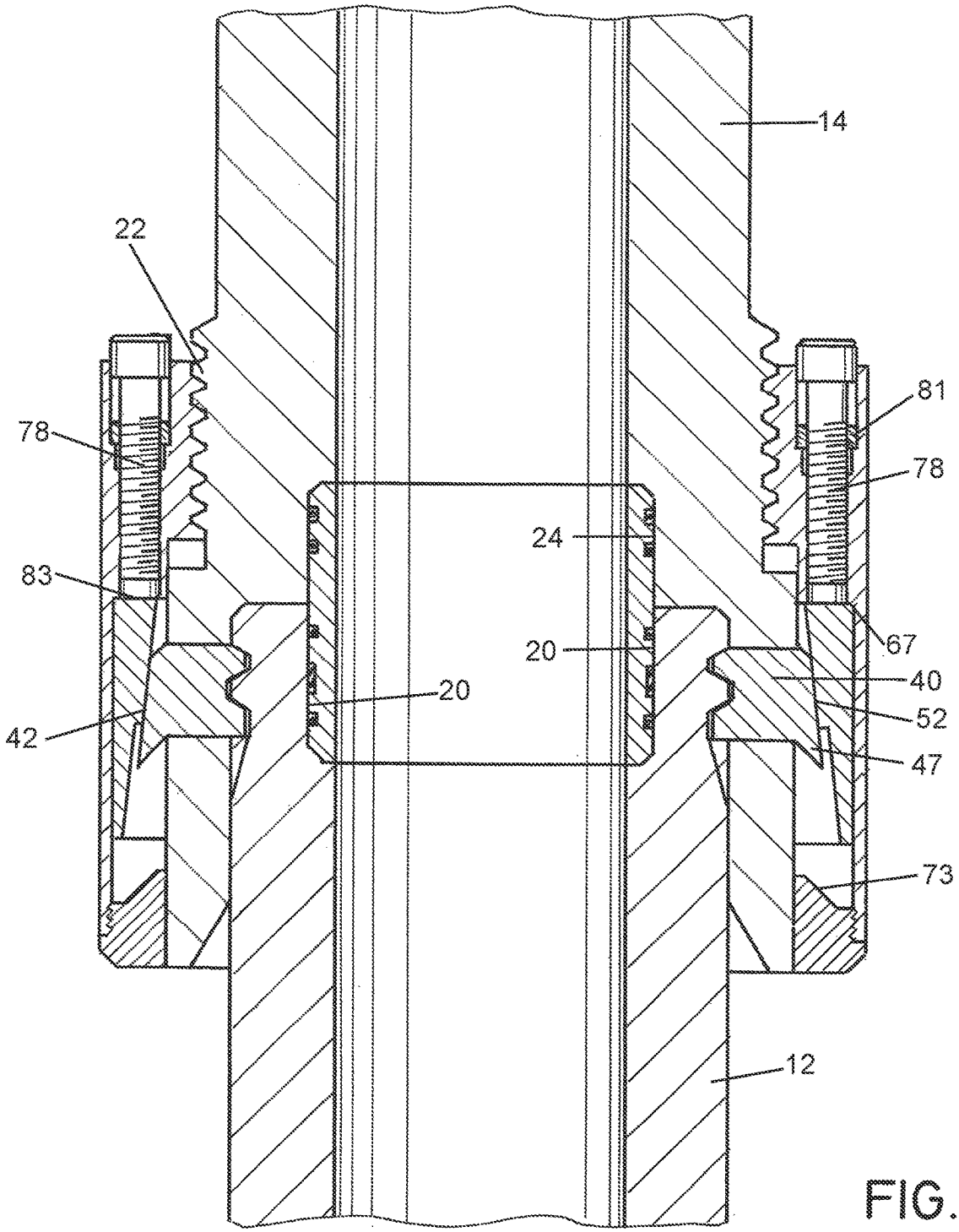
FIG. 2 is a view similar to FIG. 1 showing a primary make-up assembly engaged.

Referring now to FIGS. 3 and 2, there is shown the sequence of make-up of the connection assembly 10 of one embodiment of the present invention. With reference first to FIG. 3, connection assembly 10 is shown as being landed, but not locked. In this regard it can be seen that rib 16 on first tubular member 12 has not been received in groove 44 in dog 40. In other words, the dogs 40 are at their radially outermost position. Additionally, it can be seen that bolts 78 are in a retracted position relative to the position shown in FIG. 1.

Turning now to FIG. 2, it can be seen that collar 60 has been rotated, moving collar 60 downwardly. The downward movement of collar 60 causes shoulder 67 to engage shelf 83 on activation ring 50 forcing activation ring 50 downward. This downward movement of activation ring 50 forces tapered surface 52 on activation ring 50 into engagement with tapered surface 42 on dogs 40 resulting in radially inward movement of dogs 40 whereby groove 44 and rib 16 are engaged. This effectively locks first tubular member 12 to second tubular member 14.

At this point, bolts 78 can be rotated such that they move downwardly until they bottom on bushing 81, negating any further preload. It will be appreciated that as bolts 78 move downwardly, spacers 81 will contact the shelf 83 further forcing activation ring 50 into tighter engagement with dogs 40 forcing dogs 40 tightly into engagement with rib 16.

Although the connection assembly has been described above with reference to the use of dogs as a latch or locking element, it will be appreciated by those skilled in the art that the latch can comprise a collet, a split ring, or other type latch mechanisms which can be activated generally by radial movement.

It will be recognized that rotation of collar 60 to move collar 60 upwardly will concomitantly move retraction ring 72 upwardly until tapered surface 73 on retraction ring 72 engages the underside of projection 47 on dog 40, thereby moving dog 40 radially outwardly and out of engagement with the first tubular member 12.

It can be seen from the above that the connection assembly 10 has two make-up assemblies, one comprising the dogs 40, the other comprising the bolts 78.

It will be appreciated that when collar 60 stops, all gaps (between) are eliminated. Subsequently torquing the bolts 78 further compresses the activation ring 50 to provide significant preload. When the bolts 78 bottom on the spacers 83, no further preload is added. Thus it can be seen that the preload is independent of torque value, friction, or geometric tolerances.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A connection assembly comprising:

a first body, said first body comprising an external surface having at least one radially outwardly facing latching formation;

a second body having a portion in surrounding relationship to said first body and overlapping said latching formation, said second body having at least one radially facing window;

a latch, said latch being radially movable and configured to selectively engage said latching formation, said latch comprising a dog, said dog being selectively receivable in said at least one radially facing window:

an activation ring in surrounding relationship to said latch; and a collar threadedly received on said second body, rotation of said collar to move said collar axially toward said first body resulting in axial movement of said activation ring into engagement with said latch, whereby said latch is moved into engagement with said latching formation.

2. The connection assembly of claim 1, wherein said collar comprises an annular wall having a first internal diameter section and a second, axially spaced internal diameter section, said second diameter section having a larger diameter than said first diameter section, an axially facing, annular shoulder being formed at the intersection of said first and second sections.

3. The connection assembly of claim 2, wherein said activation ring has an annular axially facing shelf, said shoulder in said collar being selectively engageable with said shelf.

4. The connection assembly of claim 3, wherein said collar includes a second internally threaded portion formed in said second diameter section of said collar.

5. The connection assembly of claim 2, wherein there is a first internally threaded portion formed on said first diameter section of said collar, and a second internally threaded portion formed on said second diameter section of said collar.

6. The connection assembly of claim 5, wherein said second threaded portion is threadedly connected to an annular retraction ring.

7. The connection assembly of claim 6, wherein said retraction ring has an annular, axially facing chamber, and said dog has an axially extending projection, said axially extending projection on said dog being selectively engageable with said chamfer on said retraction ring.

8. The connection assembly of claim 7, wherein said dog has a radially inwardly facing groove, and said latching formation comprises an annular, radially outwardly projecting rib, said rib being selectively receivable in said groove on said dog.

9. The connection assembly of claim 5, wherein there are a plurality of circumferentially spaced, axially extending threaded bores through said first diameter wall section of said wall of said collar.

10. The connection assembly of claim 9, wherein each of said bores has a counterbore forming an internal annular shoulder.

11. The connection assembly of claim 10, wherein there is a threaded bolt received in each of said bores, each of said bolts having a first end and a second end.

12. The connection assembly of claim 11, wherein there is a bearing disposed in said counterbore.

13. The connection assembly of claim 12, wherein there is a spacer connected to the second end of said bolt.

14. The connection assembly of claim 13, wherein each of said spacers is selectively engageable with an annular, axially facing shelf formed on said activation ring.

15. The connection assembly of claim 2, wherein said second diameter portion of said collar forms an internal annular recess.

16. The connection assembly of claim 15, wherein said activation ring is received in said recess.

17. The connection assembly of claim 1, wherein said dog has a radially outwardly facing tapered surface, and said activation ring has an annular radially inwardly facing mating surface.

18. A connection assembly comprising:

a first body, said first body having a first bore and at least one latching formation;

a second body having a second bore and a portion in surrounding relationship to said first body and overlapping said latching formation;

a latch, said latch being radially movable and configured to selectively engage said latching formation;

an activation ring in surrounding relationship to said latch; and a collar threadedly received on said second body, axial movement of said collar toward said first body resulting in engagement of said activation ring with said latch, whereby said latch is moved into engagement with said latching formation, said collar comprising an annular wall having a first internal diameter section and a second, axially spaced internal diameter section, said second diameter section having a larger diameter than said first diameter section, an axially facing, annular shoulder being formed at the intersection of said first and second sections, and wherein said second diameter section forms an internal annular recess whereby said activation ring is received in said recess.

19. The connection assembly of claim 18, wherein said latch comprises a dog.

20. A connection assembly comprising:

a first body, said first body comprising an external surface having at least one radially outwardly facing latching formation;

a second body having a portion in surrounding relationship to said first body and overlapping said latching formation;

a latch, said latch being radially movable and configured to selectively engage said latching formation, an activation ring in surrounding relationship to said latch; and a collar threadedly received on said second body, rotation of said collar to move said collar axially toward said first body resulting in axial movement of said activation ring into engagement with said latch, whereby said latch is moved into engagement with said latching formation, said collar comprising an annular wall having a first internal diameter section and a second, axially spaced internal diameter section, said second diameter section having a larger diameter than said first diameter section, an axially facing, annular shoulder being formed at the intersection of said first and second sections, and wherein there is a first internally threaded portion formed on said first diameter section and a second internally threaded portion formed on said second diameter section of said collar, and wherein there are a plurality of circumferentially spaced, axially extending threaded bores through said first diameter section.

* * * * *